US007438038B2

(12) United States Patent
Azevedo et al.

(10) Patent No.: US 7,438,038 B2
(45) Date of Patent: Oct. 21, 2008

(54) CYLINDER LINER AND METHODS CONSTRUCTION THEREOF AND IMPROVING ENGINE PERFORMANCE THEREWITH

(75) Inventors: Miguel Azevedo, Ann Arbor, MI (US); Benjamin Louis Johnson, Saline, MI (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 0 days.

(21) Appl. No.: 11/695,638

(22) Filed: Apr. 3, 2007

(65) Prior Publication Data

US 2007/0246026 A1 Oct. 25, 2007

Related U.S. Application Data

(60) Provisional application No. 60/794,363, filed on Apr. 24, 2006.

(51) Int. Cl.
*F02B 51/02* (2006.01)
*F02F 1/00* (2006.01)

(52) U.S. Cl. ..... 123/193.2; 123/272

(58) Field of Classification Search ..... 123/270, 123/272, 193.2, 271
See application file for complete search history.

(56) References Cited

U.S. PATENT DOCUMENTS

| | | | | |
|---|---|---|---|---|
| 2,624,328 | A | 1/1953 | Grinham et al. | |
| 3,476,020 | A | 11/1969 | Fangman | |
| 3,620,137 | A | 11/1971 | Prasse | |
| 3,808,955 | A * | 5/1974 | Hamada et al. | 92/169.1 |
| 4,398,527 | A | 8/1983 | Rynbrandt | |
| 4,530,340 | A * | 7/1985 | Totman | 123/669 |
| 4,706,616 | A | 11/1987 | Yoshimitsu | |
| 5,549,086 | A * | 8/1996 | Ozawa et al. | 123/193.6 |
| 5,553,585 | A * | 9/1996 | Paro | 123/193.2 |
| 5,598,818 | A | 2/1997 | Domanchuk | |
| 5,701,861 | A | 12/1997 | Hegemier et al. | |
| 6,044,820 | A | 4/2000 | Domanchuk et al. | |
| 6,044,821 | A | 4/2000 | Weng | |
| 6,158,407 | A | 12/2000 | Mizutani | |
| 6,164,260 | A * | 12/2000 | Bock | 123/193.2 |
| 6,244,934 | B1 * | 6/2001 | Miyai et al. | 451/38 |
| 6,367,463 | B1 | 4/2002 | Nurmi | |
| 6,508,240 | B1 | 1/2003 | Bedwell et al. | |
| 6,622,685 | B2 * | 9/2003 | Takahashi et al. | 123/193.2 |
| 6,640,765 | B2 * | 11/2003 | Land et al. | 123/193.2 |
| 6,684,844 | B1 * | 2/2004 | Wang et al. | 123/193.1 |
| 6,736,101 | B2 * | 5/2004 | Kano et al. | 123/193.2 |
| 6,817,333 | B2 * | 11/2004 | Wang et al. | 123/193.2 |
| 7,104,240 | B1 | 9/2006 | Vuk et al. | |
| 2005/0279296 | A1 * | 12/2005 | Coney et al. | 123/41.84 |
| 2007/0107689 | A1 * | 5/2007 | Oogake et al. | 123/193.2 |

* cited by examiner

*Primary Examiner*—Hai H Huynh
(74) *Attorney, Agent, or Firm*—Robert L. Stearns; Dickinson Wright PLLC

(57) ABSTRACT

A cylinder liner for an internal combustion diesel engine and corresponding method of construction and method of improving engine performance therewith has a cylindrical inner wall providing a bore extending along a central axis for reciprocation of a piston therein. The inner wall has an axial lower portion and an axial upper portion. The lower portion has a first diameter below a top-dead-center plane and the upper portion has a second diameter provided by a material formed as one piece with the inner wall, wherein the first diameter is greater than the second diameter.

19 Claims, 2 Drawing Sheets

CYLINDER LINER AND METHODS CONSTRUCTION THEREOF AND IMPROVING ENGINE PERFORMANCE THEREWITH

CROSS-REFERENCE TO RELATED APPLICATION

This application claims the benefit of U.S. Provisional Application Ser. No. 60/794,363, filed Apr. 24, 2006, which is incorporated herein by reference in its entirety.

BACKGROUND OF THE INVENTION

1. Technical Field

This invention relates generally to internal combustion engines, and more particularly to cylinder liners for diesel engines.

2. Related Art

It is known that diesel engines consume relatively high amounts of oil, and in the process, produce undesirable exhaust emissions. As such, continual efforts exist to both improve diesel engine oil consumption performance, which in turn, results in improved exhaust emissions. Unfortunately, due to the materials commonly used for diesel engine cylinder liners, such as cast iron and steel, and the cylinder bore finishing processes required, such as honing, to attain high performance standards for the engine, there is little progress being made with respect to the liner to improve oil consumption and to reduce exhaust emissions.

With this, there is one known design feature that can be used on the liner side to improve oil consumption, and in turn, reduce exhaust emissions. The feature goes by several names, including "saver rings", "anti-polishing rings", "fire rings", "anti-scuffer rings", and "scraper rings". Regardless of its name, the feature is an annular band made of suitable material that is inserted into an annular recess machined in the top of the cylinder liner. The annular band has an inner diameter providing an overhanging portion that is slightly less in diameter than the inner diameter of the cylinder liner, with the overhanging portion taking up most of the crevice volume, wherein the crevice volume is defined by an inner wall of the cylinder liner, a piston top ring and piston top land.

As such, the overhanging portion of the annular band acts to clean the top land of the piston as the piston approaches a top-dead-center position (TDC) by scraping deposits from the land, sometimes referred to as bore polishing. In addition, the overhanging portion of the band acts as a mechanical barrier to upward scraped oil and oil throw-off, both of which are major contributors to oil consumption. As such, the band provides beneficial results in that it reduces oil consumption, reduces exhaust emissions, and also prolongs the useful life of the engine.

Although the annular bands described above are beneficial to the performance of the engine and to the environment, they come at a cost. As explained, the bands are constructed as separate rings of material, and thus, not only due the bands require separate manufacturing operations from the cylinder liner, but also require the cylinder liner to have secondary machining operations for their installation. In addition, given the nature of their use, the tolerances between the band and the cylinder liner need to be closely controlled to ensure proper performance of the engine. Accordingly, manufacturing and assembly efficiencies are diminished through the incorporation of the bands, and thus, the cost to produce engines utilizing the bands is increased.

A cylinder liner manufactured according to the present invention overcomes or greatly minimizes any limitations of the prior art described above, thereby allowing diesel engines to operate at an increased performance level, while reducing their oil consumption and exhaust emissions, and improving their useful life, all at a reduced overall cost.

SUMMARY OF THE INVENTION

A cylinder liner for an internal combustion diesel engine manufactured in accordance with the present invention reduces exhaust emissions, improves the running performance of the engine, and increases the useful life of the engine. The cylinder liner has a cylindrical inner wall providing a bore extending along a central axis for reciprocation of a piston therein. The inner wall has an axial lower portion and an axial upper portion separated from one another by a plane extending transversely to the central axis at a top-dead-center position of an upper piston ring. The lower portion has a first diameter below the top-dead-center plane and the upper portion has a second diameter provided by a material formed as one piece with the inner wall, wherein the first diameter is greater than the second diameter. The cylinder liner material extending radially inwardly can be, for example, extruded from the inner wall to define a pattern of radially inwardly extending peaks and radially outwardly extending valleys, or it can be bonded to the inner wall, such as by spray coating, screen printing, or the like, or embossed on the inner wall.

Another aspect of the invention provides a method of inhibiting gas and fluid flow axially beyond a portion of a cylinder liner inner wall, wherein the inner wall has a lower portion through which a piston reciprocates and an upper portion separated axially from the lower portion by a top-dead-center position of a top piston ring. The method includes forming a surface of material on at least a portion of the upper portion, wherein the surface of material extends radially inwardly from the lower portion to inhibit gas and fluid flow thereby.

The method, among other things, can include forming the surface of material, for example, by extruding the inner wall material, bonding a layer of material to the inner wall, such as by spray coating the surface of material to the inner wall or screen printing the surface of material to the inner wall, or embossing the inner wall to form the surface of material.

Yet another aspect of the invention provides a method of constructing a cylinder liner. The method includes forming a bore having an inner wall in a cylinder block. The inner wall is formed extending along a central axis and has an axial lower portion with a first diameter for reciprocation of a piston therein and an axial upper portion separated from said lower portion by a plane extending transversely to the central axis at a top-dead-center position of an upper piston ring. The method further includes forming a surface of material on the upper portion such that the surface of material has a second diameter that is reduced from the first diameter.

Accordingly, cylinder liners produced in accordance with the invention are useful for inhibiting the flow of oil and gases outwardly from the cylinder bore via exhaust emissions, while also reducing the rate of oil consumption and extending the useful life of the engine. In addition, the cylinder liners are economical in manufacture, in assembly, and in use. Accordingly, the total cost to implement a mechanism to reduce oil consumption and exhaust emissions, and increase the useful life of the engine, is reduced.

BRIEF DISCUSSION OF THE DRAWINGS

These and other aspects, features and advantages will become readily apparent to those skilled in the art in view of the following detailed description of the presently preferred embodiments and best mode, appended claims, and accompanying drawings, in which:

DETAILED DESCRIPTION OF PREFERRED EMBODIMENTS

Figure 1:
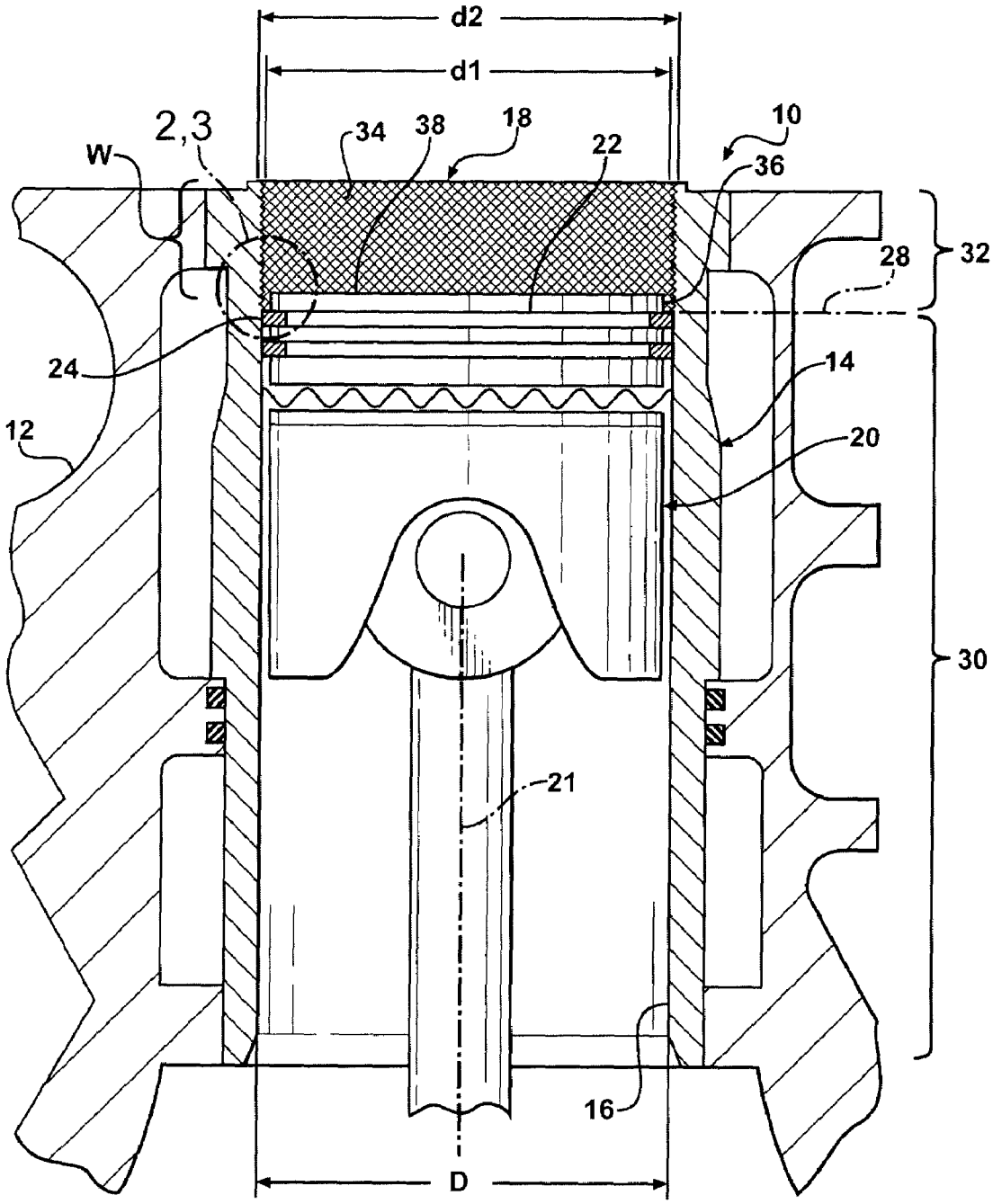
FIG. 1 is a cross-sectional view of a cylinder liner constructed according to one presently preferred embodiment of the invention with a piston therein shown at a top-dead-center-position.
Figure 2:
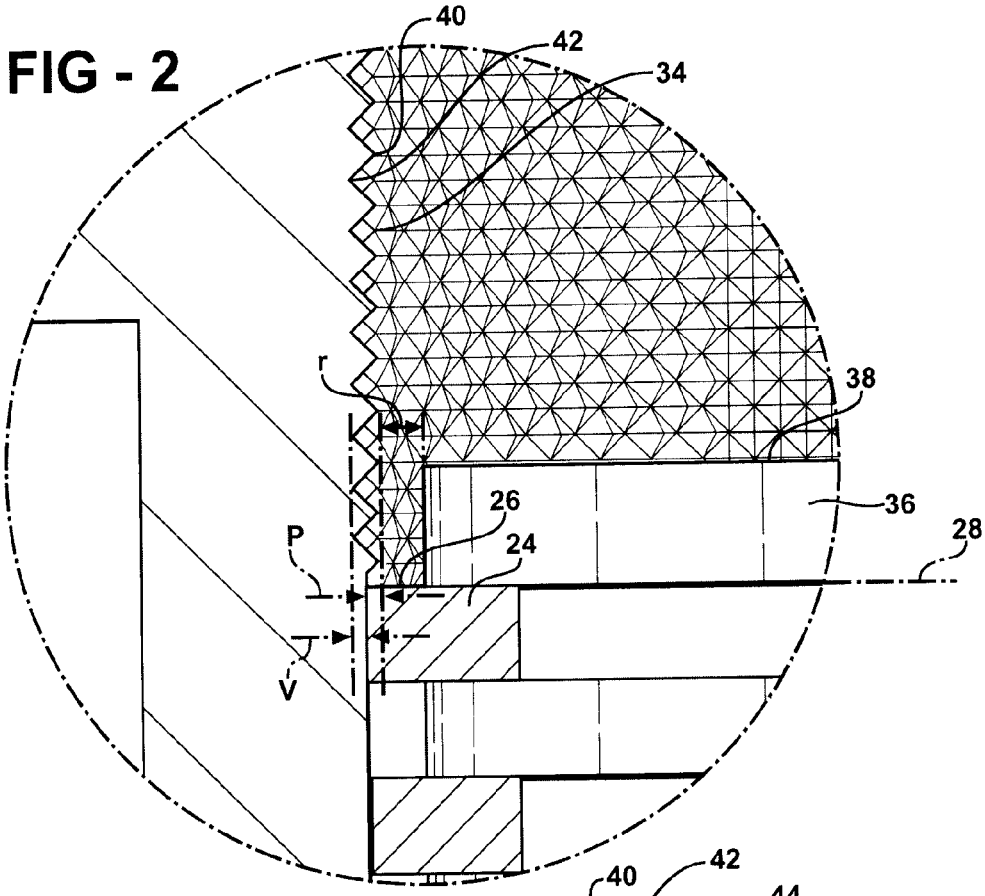
FIG. 2 is an enlarged fragmentary view of the encircled area of FIG. 1 shown in an initial state of use.

Referring in more detail to the drawings, FIG. 1 illustrates a cylinder liner 10 constructed according to one presently preferred embodiment of the invention disposed in a cylinder block 12 of a diesel engine. The cylinder liner 10 has a body 14 with a cylindrical inner wall 16 defining a cylinder bore 18 for reciprocation of a piston 20 along a central axis 21 therein. The piston 20 typically has at least one annular ring groove 22 for floating receipt of a piston ring, wherein a top upper most piston ring 24 facilitates guiding the piston 20 during reciprocation, while also inhibiting the passage of oil upwardly from below the piston 20. FIG. 1 shows the piston 20 in a top-dead-center (TDC) position, with the top piston ring 24 having an upper surface 26 (FIGS. 2 and 3) coinciding with an imaginary annular TDC line or plane 28 that extends generally transversely to the central axis 21 about the inner wall 16. The TDC plane 28 separates two portions of the cylinder bore 18, with a lower portion 30 having a first diameter D being defined below the TDC plane 28, through which the piston reciprocates, and an upper portion 32 having a second diameter d1 being defined above the TDC plane. The upper portion 32 includes a material 34 that can be formed as one monolithic piece with the inner wall 16. The material 34 extends radially inwardly toward the central axis 21 of the cylinder bore 18 relative to an inner diameter D of the surface 16 of the lower portion 30.

Figure 3:
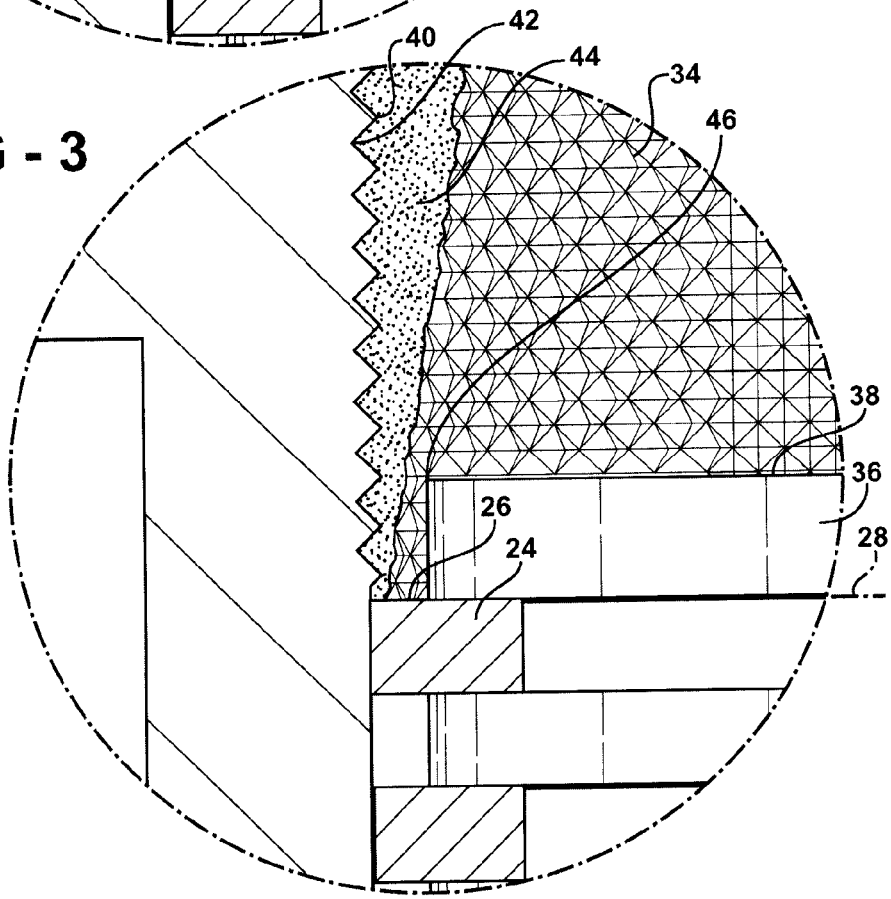
FIG. 3 is a view similar to FIG. 2 shown after some use.

The material 34 inhibits the flow of fluid and gases thereby, thus, reducing the amount of oil expelled via "oil-scrape" or "throw-off" (results from oil above the upper most piston ring being thrown upwards by the piston 20 and/or piston ring 24 during an upstroke of the piston) upwards into the exhaust emissions, while also acting to provide a labyrinth to combustion gases flowing toward the uppermost piston ring 24. Accordingly, any localized formation of oxidized lubrication is inhibited from building up on a back of the piston ring groove 22, which in turn, acts to prevent a condition know as "carbon jacking" of the rings 24, or "sticking" of the rings 24. Further, the material 34 acts to remove or scrape carbon buildup from an upper land portion 36 of the piston 20, wherein the upper land portion 36 is defined generally between the uppermost ring 24 and a crown 38 of the piston 20. This is particularly true after some use of the engine has occurred, wherein some desirable amount of carbon buildup (FIG. 3, showing build-up in the foreground with the background shown without build-up for illustration purposes only) has formed on the material 34. Accordingly, the cylinder liner 10 provides a cost effective mechanism in which to reduce exhaust emissions, improve oil consumption and extend the useful life of the engine.

The material 34 on the upper portion 32 of the liner 10 is preferably formed to provide a cold radial clearance (r) with the upper land 36 of the piston 20, down to about 0.100 mm. Generally, the material 34 is formed to the reduced inner diameter d1 over at least a section of the upper portion 32 by about 0.5-1.5% relative to the inner diameter D of the lower portion 30. The width (w) of the material 34 extends axially along the central axis 21, and can be varied in length of coverage, as desired, however, it preferably extends to an area of the cylinder upper portion 32 immediately adjacent the imaginary TDC plane 28. As such, scraping of the upper land 36 of the piston 20 is facilitated in use, as shown in FIG. 3.

The cylinder liner 10, with the material 34 formed on the upper portion 32, can be further processed, such as machined, heat treated, whether cased hardened or through hardened, without any additional challenges. However, given that the inner diameter d1 of the upper portion 32 is reduced from the inner diameter D of the lower portion 30, it is generally preferred, and in some cases necessary to assemble the piston 20, with rings 24 assembled thereon, into the cylinder liner 10 from its underside, with the piston 20 being linked to the connecting rod (not shown), prior to assembling the cylinder block 12 to the engine block.

The material 34 extending radially inwardly from the inner wall 16 can be formed by one of several mechanisms. For example, the material 34 can be formed in an extruding process wherein the material of the inner wall 16 is extruded or knurled from the material of the cylinder liner to produce peaks 40 (FIGS. 2 and 3) extending radially inwardly relative to the inner diameter D of the lower portion 30 by a predetermined distance P, such that the peaks 40 define the second diameter d1, and valleys 42 extending radially outwardly relative to the inner diameter D of the lower portion 30 by a predetermined distance V to define a third diameter d2. With this construction of the material 34, the diameter D of the lower portion 30 is greater than the diameter d1 of the peaks 40 and the diameter d2 of the valleys 42 is greater than the diameter D of the lower portion 30. Preferably, a uniform pattern of the peaks 40 and valleys 42 is formed, such as in a diamond-like or cross-hatch pattern, for example. Other than extruding, the material 34 can be plastically formed utilizing other material upsetting processes, such as embossing or media blasting, for example. It should be recognized that masking can be used to prevent upsetting material on the inner surface of the lower portion 30, and thus, the formation of the material 34 can be restricted to the upper portion 32 of the inner wall 16. It should also be recognized that in addition to forming the material 34 as a monolithic piece with the upper surface 32, the material 34 can be formed by bonding a layer of additional material as one piece with the inner wall 16, such as by screen printing or spray coating, for example. Further, it should be recognized that where a separate material is applied to the inner wall 16, that the material 34 is selected from a suitable material to withstand the operating environment of the engine. It should also be recognized that regardless of how the radially inwardly extending material 34 is formed that it is preferably formed in accordance with the cold radial clearance parameters set forth above.

In use, the material 34 formed on the upper surface 32 acts to benefit operation of the engine in a number of ways. Initially, the material 32 provides a labyrinth to inhibit the downward flow of hot combustion gases and fluid toward the upper most piston ring 24 and groove 22. As such, the ingress of hot gases and fluid from the combustion chamber past the upper most piston ring 24 is inhibited, thereby retarding local oxidation of lubricant and diminishing carbon formation within and on the back side of the groove 22, thereby promoting proper functioning of the piston rings 24. As mentioned, this acts to reduce the likelihood of ring jacking or sticking from occurring, and thus, the useful life and efficiency of the engine between servicing is enhanced.

As use of the engine continues over time, the radially inwardly extending material 34 acts to attract and accumulate a desired amount of build up (FIG. 3), such as carbon deposits 44, thereon. The accumulation begins with oil being deposited on the surface of the material 34, wherein cohesion of the oil on the surface is enhanced by the undulating geometry of the peaks 40 and valleys 42, whereupon the oil is oxidized to begin forming the layers of carbon deposits 44. The build up of carbon deposits 44 serves as a mechanical barrier to gas penetration downwardly, while also acting as a barrier to oil scrape and throw-off upwardly. The amount of carbon build-up 44 is self-regulating as a result of an upper edge 46 of the piston top land 36 scraping away any excess build-up during an upward stroke of the piston 20. Accordingly, any carbon scraped off will be either consumed/burned during combustion or discharged during the exhaust stroke. Given the minute amounts of carbon formation per engine thermodynamic cycle, any excess is easily processed and consumed by the engine itself.

The mechanical barrier 44 formed by carbon build-up, which is facilitated by the material 34, thus, performs at least two important roles in increasing the running performance of the engine. First, it inhibits gas and fluid penetration downwards, and second, it inhibits oil scrape and throw-off upwards. The first of which acts to increase the useful life of the engine, such as by preventing the onset of ring jacking and sticking, while the second acts to improve the oil consumption of the engine and reduce exhaust emissions.

Accordingly, a cylinder liner 10 constructed within the scope of the present invention, as defined by the claims, provides at least the benefits of the bands discussed in the background section above, which, as mentioned, require complex and precise machining and secondary installation, without having to incur the negative aspects associated therewith. Further, it is believed that the useful life of the engine between servicing can be further enhanced relative to the useful life attainable through the use of the aforementioned bands. Also, cylinder liners of any size and thickness can benefit from the invention herein, unlike the use of separate bands, which require that the cylinder liners are of suitable thickness to form the radially outwardly extending grooves or recess for their receipt therein.

It is to be understood that other embodiments of the invention which accomplish the same function are incorporated herein within the scope of any ultimately allowed patent claims.

What is claimed is:

1. A cylinder liner for an internal combustion diesel engine, comprising:

a cylinder body having an inner wall providing a bore extending along a central axis for reciprocation of a piston therein, said inner wall having an axial lower portion and an axial upper portion separated from one another by a plane extending transversely to said central axis, said lower portion having a first diameter and said upper portion being made of the same material as that of said cylinder body and textured such that some of said upper portion extends radially inwardly of said first diameter and some of said upper portion extends radially outwardly of said first diameter.

2. The cylinder liner of claim 1 wherein said texture comprises embossed material of said cylinder body.

3. The cylinder liner of claim 2 wherein said embossed material defines a pattern of radially inwardly extending peaks and radially outwardly extending valleys relative to said first diameter.

4. The cylinder liner of claim 3 wherein said peaks define a second diameter and said valleys define a third diameter, said third diameter being greater than said first diameter.

5. The cylinder liner of claim 4 wherein said second diameter is reduced from said first diameter between about 0.5 and 1.5 percent.

6. The cylinder liner of claim 3 wherein said pattern is generally diamond shaped.

7. A method of inhibiting gas and fluid flow axially beyond a portion of a cylinder liner inner wall, the inner wall having a lower portion through which a piston reciprocates and an upper portion separated axially from the lower portion by a top-dead-center position of a top piston ring, the method comprising:

embossing a textured surface of material on at least a portion of the upper portion, a portion of said embossed textured surface of material extending radially inwardly from the lower portion to inhibit gas and fluid flow thereby and a portion of said embossed textured surface extending radially outwardly from the lower portion.

8. The method of claim 7 further including embossing a uniform pattern in the surface of material.

9. The method of claim 7 further including forming a plurality of peaks extending radially inwardly relative to said lower portion in the embossing step.

10. The method of claim 9 further including forming a plurality of valleys extending radially outwardly relative to said lower portion in the embossing step.

11. The method of claim 7 further including forming said surface of material by bonding a layer of material to the inner wall.

12. The method of claim 11 further including spray coating said layer of material to the inner wall.

13. The method of claim 11 further including screen printing said layer of material to the inner wall.

14. The method of claim 7 further including providing the lower portion with a first diameter and forming said surface of material having a second diameter that is reduced from said first diameter between about 0.5 and 1.5 percent.

15. A method of constructing a cylinder liner, comprising:

forming a bore in a cylinder block, said bore having an inner wall extending along a central axis, said inner wall having an axial lower portion with a first diameter for reciprocation of a piston therein and an axial upper portion separated from said lower portion by a plane extending transversely to said central axis at a top-dead-center position of an upper piston ring; and mechanically deforming a surface of material on said upper portion to displace some of the material radially inwardly beyond the first diameter and to form depressions in the material extending radially outwardly of the first diameter, said surface of material having a second diameter that is reduced from said first diameter.

16. The method of claim 15 further including forming said surface of material by embossing the inner wall of the cylinder block material.

17. The method of claim 16 further including forming a plurality of peaks extending radially inwardly relative to said lower portion and a plurality of valleys extending radially outwardly relative to said lower portion in the embossing step.

18. The method of claim 15 further including forming said surface of material by bonding a layer of material to the inner wall.

19. The method of claim 15 further including forming said second diameter having a diameter that is reduced from said first diameter between about 0.5 and 1.5 percent.

* * * * *